United States Patent [19]

Demuth et al.

[11] 4,076,052

[45] Feb. 28, 1978

[54] SYSTEM FOR TRANSFERRING A YARN FROM ONE PART OF A TEXTILE MACHINE TO ANOTHER PART

[75] Inventors: Hans Demuth, Winterthur, Switzerland; Jose R. A. Ferreira, Alverca do Alentejo, Portugal

[73] Assignee: Sulzer Brothers Limited, Winterthur, Switzerland

[21] Appl. No.: 703,003

[22] Filed: Jul. 6, 1976

[30] Foreign Application Priority Data

Jul. 4, 1975 Switzerland ..... 8736/75

[51] Int. Cl.[2] ..... D03D 47/24; D03D 47/34

[52] U.S. Cl. ..... 139/439; 139/450

[58] Field of Search ..... 139/196.2, 438, 439, 139/447, 448, 450

[56] References Cited

U.S. PATENT DOCUMENTS

| | | | |
|---|---|---|---|
| 1,906,185 | 4/1933 | Rossmann | 139/439 |
| 2,163,760 | 6/1939 | Moessinger | 139/450 |
| 3,441,061 | 4/1969 | Peracca et al. | 139/448 |
| 3,717,181 | 2/1973 | Fabre | 139/438 |

FOREIGN PATENT DOCUMENTS

| | | | |
|---|---|---|---|
| 2,123,107 | 12/1970 | France | 139/448 |

*Primary Examiner*—Henry S. Jaudon

*Attorney, Agent, or Firm*—Kenyon & Kenyon, Reilly, Carr & Chapin

[57] ABSTRACT

The clips which are used to transfer the yarn, e.g. a ribbon yarn, have clamping surfaces which are disposed in cross-wise manner but at an inclined angle from a true perpendicular. For example, the clamping surfaces of one clip are inclined at an angle of at least 4° from the perpendicular to the clamping surfaces of the other clip. The inclination of the clamping surfaces to each other may be obtained by setting the clamping surfaces at an angle to the jaws of the clips. Also, the clamping surfaces may be twisted within a clip.

8 Claims, 7 Drawing Figures

SYSTEM FOR TRANSFERRING A YARN FROM ONE PART OF A TEXTILE MACHINE TO ANOTHER PART

This invention relates to a system for transferring a yarn from one part of a textile machine to another part.

Heretofore, various systems have been known for transferring a piece of material in yarn form from a first guide part of a machine to a second such part, particularly for a textile machine. In many cases, these systems employ two clips which are adapted to be brought together in a transfer position and which each engage the piece of material between two overlapping clamping surfaces of two jaws, at least one of which is movable with respect to the other. The pairs of the clamping surfaces of the two clips have been arranged cross-wise with respect to one another in the transfer position as considered in the direction of the longitudinal axis of the piece of material so as to permit transfer from one clip to the other.

Systems of this kind are known, for example, in conjunction with weaving machines in which a weft yarn drawn from a supply bobbin which remains outside the shed is picked into the shed by a picking means, e.g. a gripper shuttle, and after each pick is engaged by two selvage yarn clips and cut off at the weft side of the shed. Generally, the weft yarn end is engaged by a clip having, for example, horizontal clamping surfaces, and is transferred to another picking means held in readiness for the next pick, where it is engaged by a clip having clamping surfaces at right angles to the first clip. The fact that the pairs of clamping surfaces of the two cooperating yarn clips are in a cross-wise arrangement in the transfer position means that the yarn transfer is, in each case, carried out with the accuracy required in high-speed weaving machines of this kind in which, for example, there may be over 200 picks per minute.

When flat yarn material is used, particularly yarn material in the form of a band or ribbon consisting, for example, of individual or several superposed bands of polyethyelene, polypropylene or the like, there is a risk that the band material offered horizontally by a clip, for example, on transfer with the known systems will not be engaged completely, i.e. over the entire width, by a receiving clip engaging the two edges of the material with vertical clamping surfaces. Thus, the material may become longitudinally creased or kinked or opened up. If this results, parts of the piece of material for transfer may break out and not enter the shed during picking, so that faults occur in the woven fabric.

Accordingly, it is an object of the invention to avoid creasing or kinking of ribbon yarns during transfer in a weaving machine.

It is another object of the invention to provide a simple system for use with yarn material in band form which ensures complete and reliable engagement of the material for transfer from one machine part to another part.

It is another object of the invention to provide a yarn transfer system for ribbon or band type yarns which is also adapted to transfer yarns of round cross-section.

Briefly, the invention provides a system for transferring a yarn from one part of a machine to another part of the machine wherein use is made of two clips disposed at a yarn transfer position and wherein each clip has a pair of jaws, at least one of which is movable relative to the other, and each jaw has a clamping surface facing a clamping surface of the other jaw. In accordance with the invention, the clamping surfaces of one pair of jaws is disposed in cross-wise relation to the clamping surfaces of the other pair of jaws at an angle differing from ninety degrees (90°) by at least four degrees (4°).

Because of the relative positions of the clamping surfaces, a piece of yarn material for transfer is always twisted about its longitudinal axis into a position to be engaged by the clamping surfaces of the receiving clip and, on the closing movement of the receiving clip, twisted further into the appropriate clip position without being compressed, creased, kinked or opened up.

In one embodiment, which has proved satisfactory, particularly for the drive of two cooperating clips wherein one clip has a jaw horizontally movable in the transfer position and the other clip has a vertically movable jaw, at least one of the clips has the clamping surfaces disposed at an angle to the direction of movement of the movable jaw.

In another embodiment, the piece of material for transfer may be at least partially twisted into the predetermined transfer position in the region of the clamping length of the transferring jaws if the two clamping surfaces of the associated clip are uneven and twisted. To this end, the consecutive boundary lines of each clamping surface as considered in the direction of the longitudinal axis of the piece of material are twisted relative to each other.

In order to ensure that the clamping surfaces situated at an angle to the direction of movement of the movable jaw are reliably brought together, at least one of the jaws of the clip may have a lateral guide element adapted to cooperate with the other jaw.

These and other objects and advantages of the invention will become more apparent from the following detailed description and appended claims taken in conjunction with the accompanying drawings in which:

FIG. 1 schematically illustrates some of the parts of a weaving machine involved in a picking operation;

Figure 1:
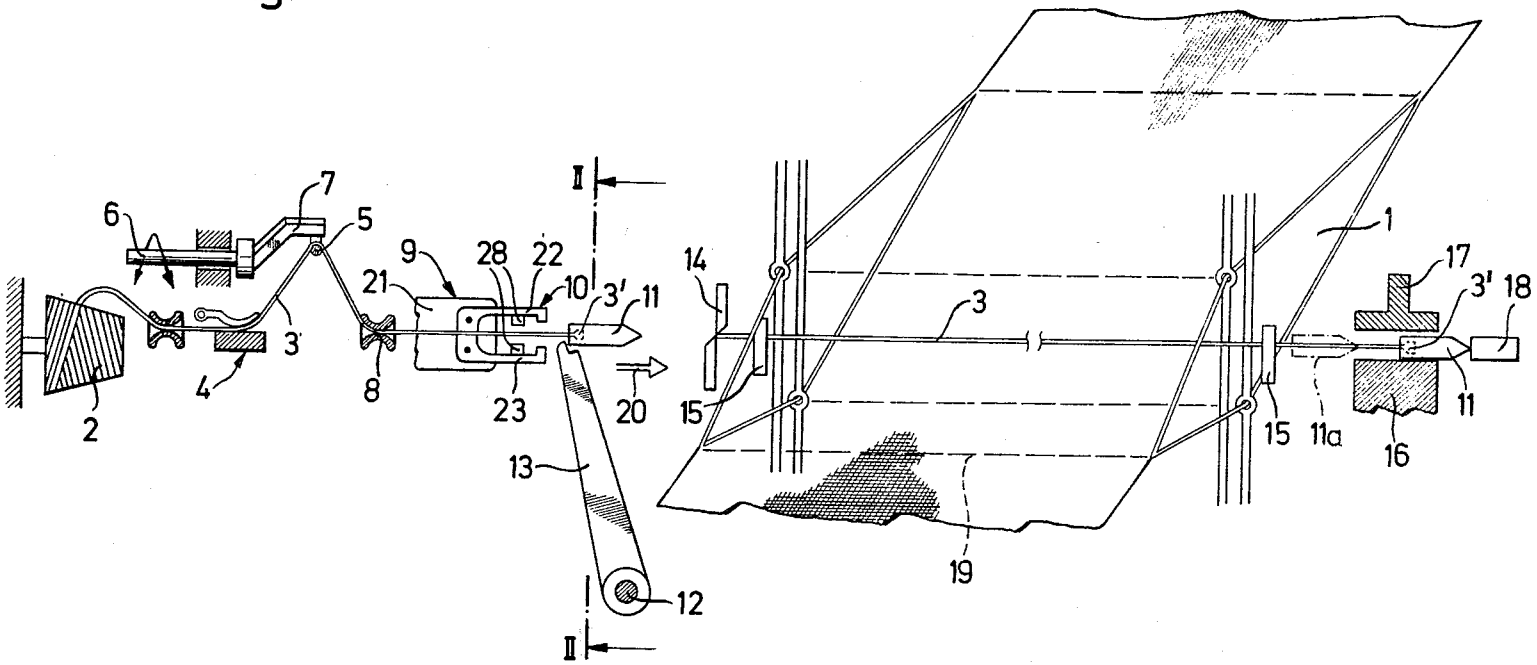

Referring to FIG. 1, a weaving machine for weaving yarn material of band or ribbon-like form in a shed 1 has a weft supply 2 which is located outside the shed 1. The weft supply 2 supplies a weft yarn 3 in the form of a band or ribbon (weft band) via a yarn brake 4, an eye 5 of a yarn tensioner 7 mounted on a pivotal shaft 6, and a stationary eye 8 to a yarn regulator 9 (yarn return). The yarn regulator 9 is located adjacent to a picking mechanism (not shown) in which a shuttle 11 (e.g. a gripper shuttle) is positioned in a position of readiness. A transfer system is also provided to transfer the weft yarn 3 from the yarn regulator 9 to the shuttle 11. This transfer system includes a clip 10 within the yarn regulator 9 and is more fully described below.

For each pick, the shuttle 11 is picked through the shed 1 in the direction of arrow 20 by a picking lever 13 disposed on a torsion rod 12, the weft yarn 3 being drawn from the supply bobbin 2 with the yarn brake 4 open. During picking, the yarn tensioner 7 is pivoted out of the position shown in FIG. 1, into a position in which the eye 5 is situated between the yarn brake 4 and the stationary eye 8. At the same time, the yarn regulator 9 is guided towards the shed 1 out of the position illustrated in which the weft yarn end 3' is transferred to the shuttle 11.

After picking, the shuttle 11 passes a shears 14 which is movable from the picking line and two selvage yarn clips 15 which are disposed on either side of the shed 1 and which are also movable out of the picking line. The shittle 11 is braked in a catcher 16 by a brake 17 and then returned by a return means 18 to an accurately-defined position **11*a* shown in dot-dash lines. At the same time, an appropriate pivoting movement of the yarn tensioner 7 causes the weft yarn 3 to be deflected between the closed yarn brake 4 and the stationary eye 8, so that the yarn length liberated on the return of the shuttle 11 is pulled back and the weft yarn 3** is kept tensioned.

The weft yarn 3 is then engaged by the selvage yarn clip 15 moved into the picking line and by the yarn regulator 9 moved towards the shears 14. Next, the yarn 3 is cut off by the shears 14, while the shuttle 11 is released from the weft yarn 3 and returned to the picking mechanism by a conveyor means (not shown). The picked weft yarn 3 clamped between the selvage yarn clips 15 is beaten up by a reed (not shown) to the edge 19, where the fabric begins, and is woven in by shedding. In the meantime, the yarn regulator 9 is moved back into the position shown in FIG. 1, in which the weft yarn end (band end) 3' is held in readiness for transfer to another weft picking shuttle. The weft yarn 3 is kept tensioned during the return of the yarn regulator 9 as well, the yarn tensioner 7 being pivoted back into the position shown in FIG. 1.

Figure 3:
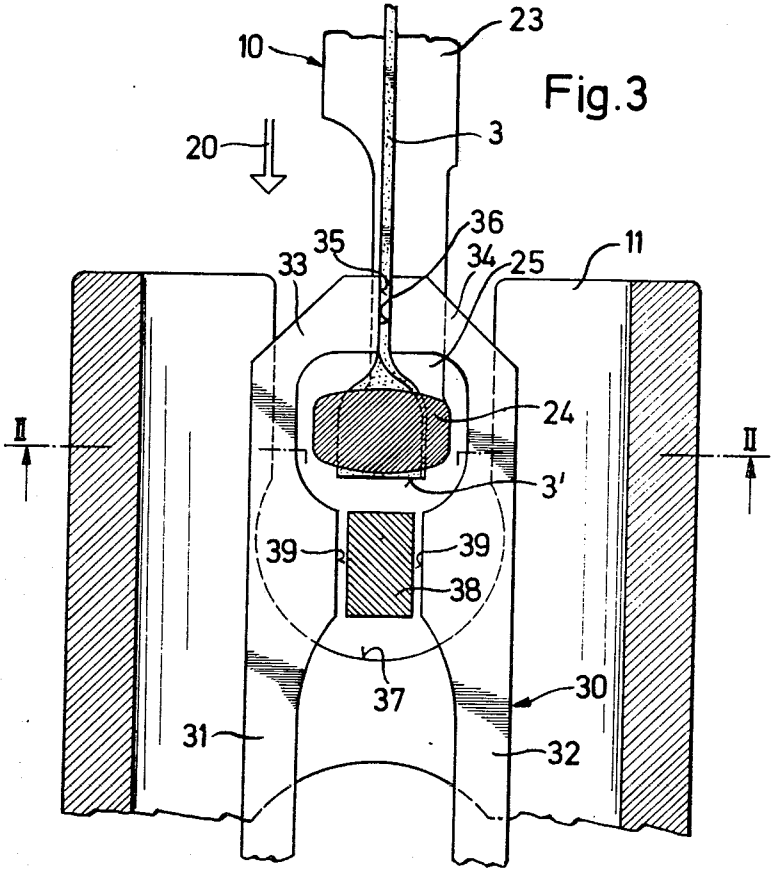
FIG. 3 illustrates a horizontal sectional view taken on line III—III of FIG. 2.
Figure 2:
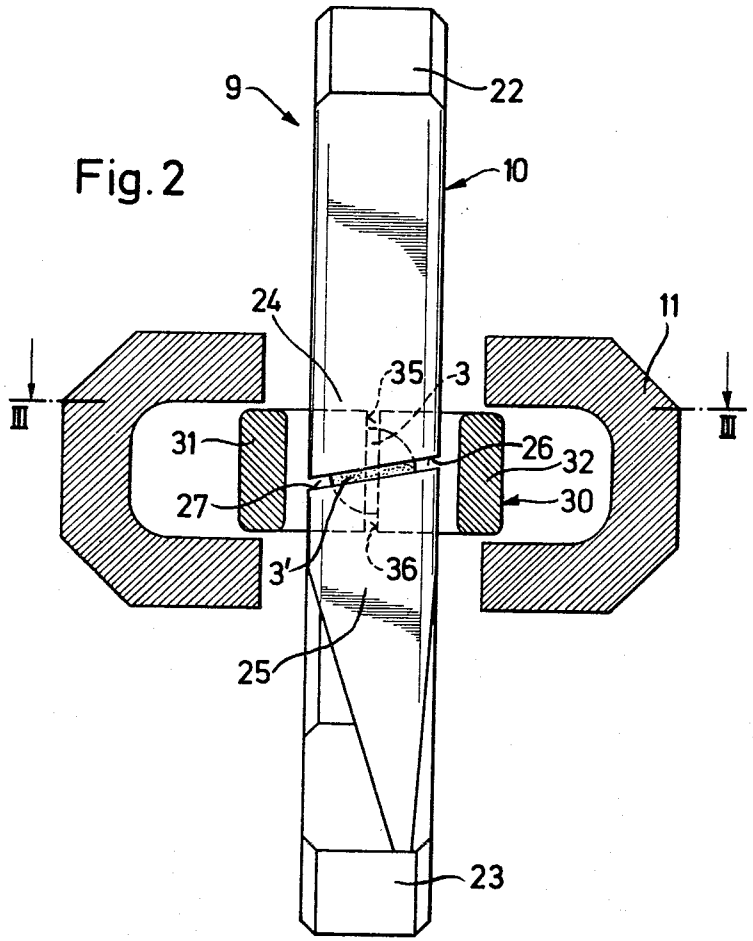
FIG. 2 illustrates a view taken on line II—II in FIG. 1 of a transfer system according to the invention.

The yarn regulator 9 contains a member 21 which is coupled to the weaving machine drive (not shown) and on which the clip 10 of the transfer assembly is fixed. The clip 10 comprises two vertically movable biassed limbs 22, 23, whose ends are constructed as jaws 24, 25 (FIG. 2) each of which has a clamping face 26, 27. The jaws 24, 25 are pressed against one another or against the weft yarn end (band end) 3' is introduced between the clamping surfaces 26, 27. As shown, the clamping surfaces 26, 27 are at an angle to the direction of movement of the jaws 24, 25, the angle being about 10° to the horizontal. FIG. 1 shows the clip 10 in the open position in which the limbs 22, 23 bear against two openers 28 which are adapted to be introduced from the side and which extend outwardly. FIGS. 2 and 3 show the clip 10 in the closed position for transfer of the weft yarn (weft band 3) to the shuttle 11.

The transfer system also includes a clip 30 in the shuttle 11 for engaging the weft yarn end (band end) 3'. This clip 30 is formed by a resilient clamp which is fixed in the shuttle body and which comprises two biassed limbs 31, 32 whose ends are constructed as jaws 33, 34. These jaws 33, 34 have clamping surfaces 35, 36 and are pressed against one another, i.e. against the band 3 to be introduced between the clamping surfaces 35, 36. In the yarn transfer position, the shuttle 11 is so guided in the picking mechanism that the limbs 31, 32 are horizontally movable, the clamping surfaces 35, 36 being vertical. An opening 37 is provided at the rear end of the shuttle 11 through which a wedge-shaped opener 38 controlled by the machine drive can be introduced between two stop faces 39 formed on the limbs 31, 32.

As indicated in FIGS. 2 and 3, the clips 10, 30 are coaxially disposed at the yarn transfer position such that the jaws of one clip are moveable relative to one another in a first plane while the jaws of the second clip are disposed for relative movement in a second plane perpendicular to the first plane.

On the transfer of the yarn to the shuttle 11 held in readiness in the picking position in the picking mechanism, the clip 30 is opened by the opener 38 introduced from above, so that the clip 10 holding the weft yarn end (band end) 3' can be brought into the position shown in FIGS. 2 and 3 by the yarn regulator 9 moving in the direction of arrow 20. In this position, the jaws 24, 25 are situated in front of the closed position of the jaws 33, 34 as considered in the direction of the pick (arrow 20). At this time, the end 3' of the weft yarn 3 is slightly twisted due to the inclination of the clamping surfaces 26, 27 of the jaws 24, 25. The clip 30 is then closed by withdrawing the opener 38. The weft yarn 3 is then further twisted by the jaws 33, 34 moving against the correspondingly twisted edges and is finally retained between the vertical surfaces 35, 36 without the yarn 3 being creased or kinked in the longitudinal direction. The clip 10 is then opened by introduction of the openers 28 so that the weft yarn end (band end) 3' is released. The shuttle 11 can then be picked through the shed 1 and the yarn regulator 9 moved towards the shears 14 so that the weft yarn (band end) 3' released on cutting can be engaged and returned to the position shown in FIG. 1 for renewed yarn transfer for the next pick.

Figure 5:
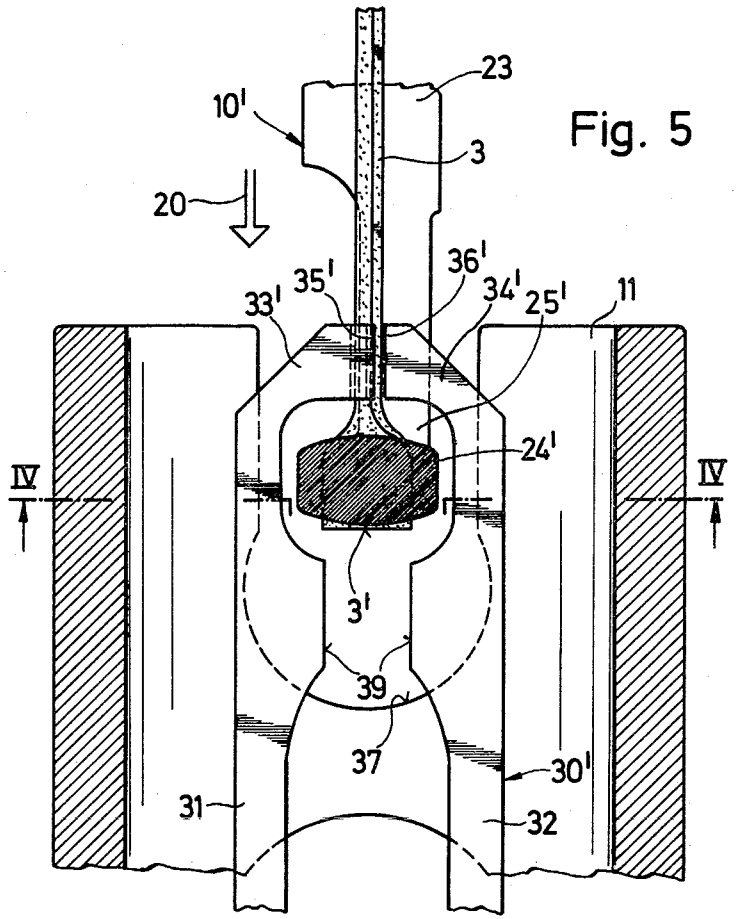
FIG. 5 illustrates a horizontal sectional view taken on line V—V of FIG. 4.
Figure 4:
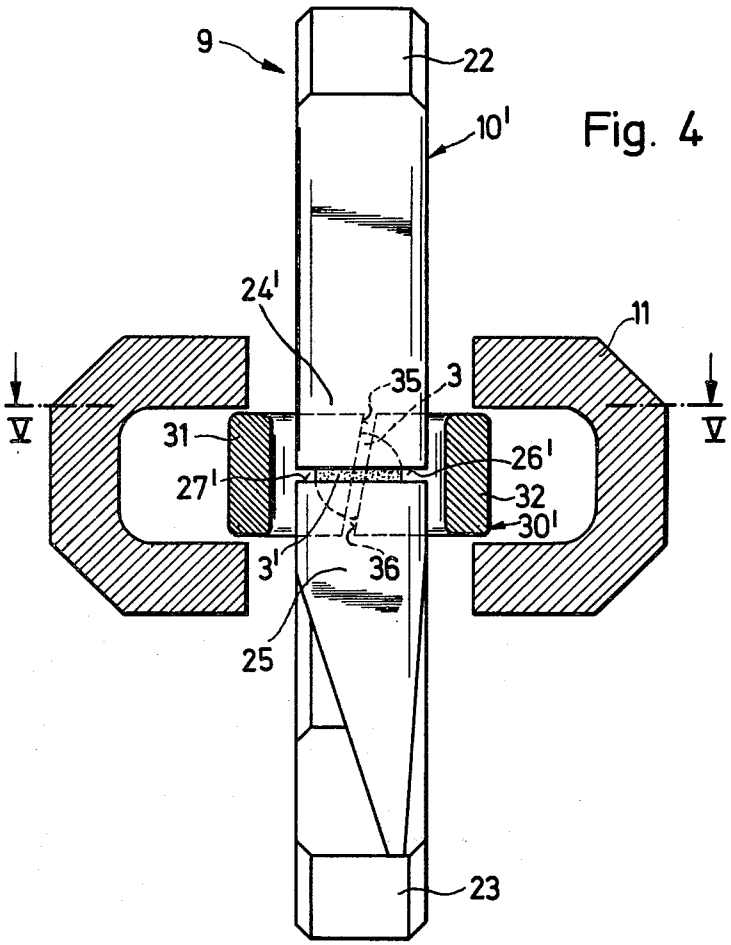
FIG. 4 illustrates a view corresponding to FIG. 2 of a modified transfer assembly according to the invention.

Referring to FIGs. 4 and 5, the clamping surfaces of the clips of the transfer assembly may be reversed such that the band or weft yarn 3 is offered horizontally by the yarn regulator 9 and twisted on each closing movement of the jaws 33', 34' of the clip 30' in the shuttle 11 and retained and picked into the shed in this inclined position. To this end, the yarn regulator 9 includes a clip 10' having two jaws 24', 25' with horizontal clamping surfaces 26', 27' perpendicular to the direction of movement of the jaws while the shuttle 11 has a clip 30' with clamping surfaces 35', 36' disposed at an angle to the direction of movement of the jaws 33', 34', e.g. inclined about 10° to the vertical in the yarn transfer position.

Figure 6:
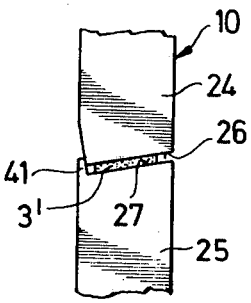
FIG. 6 illustrates a detail of a clip according to the invention in a modified embodiment.

The clip jaws cooperating with the inclined clamping surfaces can be guided by lateral stops. For example, as shown in FIG. 6, one jaw 25 of the clip 10 is provided with a lateral guide element 41 of this kind to prevent any relative displacement of the clamping surfaces 26, 27 when the jaws 24, 25 are pressed together.

Figure 7:
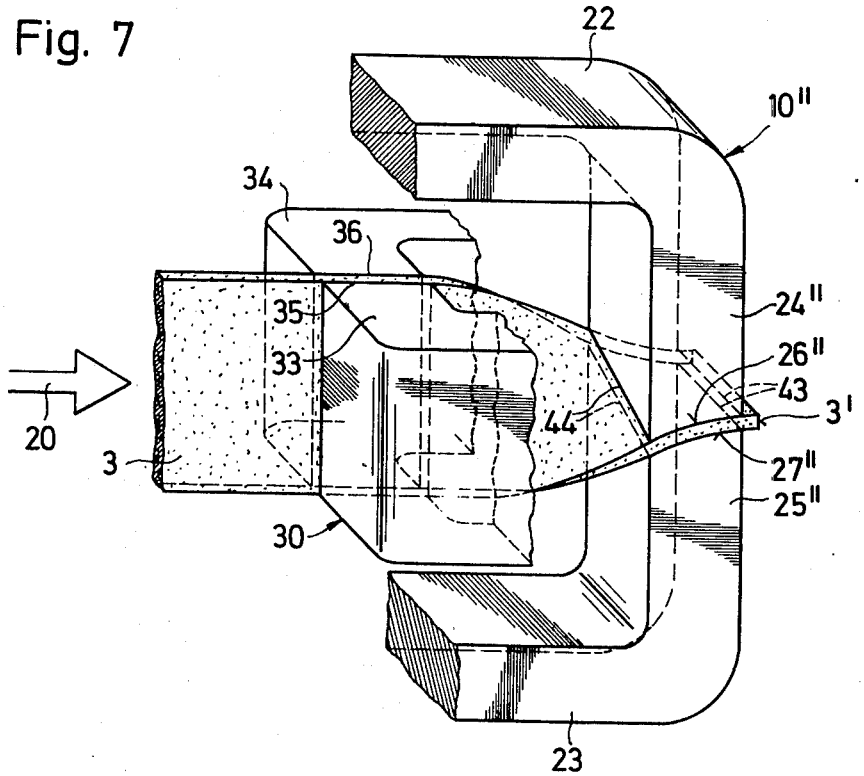
FIG. 7 illustrates the main parts of two cooperating clips in another modified embodiment according to the invention in perspective to an enlarged scale.

Referring to FIG. 7, the jaws of the clips of the transfer assembly may be arranged so that the weft yarn 3 is twisted before being gripped by the receiving clip so as to be taken over in an unkinked condition. To this end, two jaws 24'', 25'' of a transferring clip 10'' are provided with uneven twisted clamping surfaces 26'', 27'' with consecutive boundary lines being twisted relative to each other, i.e. the front edges 43, as considered in the picking direction (arrow 20), are horizontal while the rear edges 44 are twisted against the horizontal substantially about the longitudinal axis of the weft yarn (weft band) 3. Accordingly, the yarn end (band end) 3' has already been so twisted between the jaws 24'', 25'' that it can be taken over unkinked by the jaws 33, 34.

Various other embodiments of the invention are also possible, for example, the clips can have one stationary and one movable jaw. Also, both of the cooperating clips may have clamping surfaces at an angle to the direction of movement of the opening or closing jaws. Further, instead of the jaws having clamping surfaces at an angle to their direction of movement, it is possible to use jaws having clamping surfaces perpendicular to their direction of movement with the pairs of jaws being so disposed that their directions of movement are offset by an angle other than 90°.

The angle by which the two cooperating pairs of clamping surfaces are offset from one another may have practically any value, according to the width and nature of the material, provided the deviation from the perpendicular relative to the pair of clamping surfaces of the other clip is greater than the frictional angle between the material for engagement and the clamping surfaces, which may, for example, be four degrees (4°) or more.

Of course, the transfer assembly of the invention is also applicable, for example, to the selvage yarn clips of the weaving machine described or other parts, e.g. weft picking needles of textile machines or corresponding machines for handling yarn-like material, e.g. typing or packing machines or the like. The apparatus according to the invention is particularly suitable for use with material in the form of bands or ribbons but can be used universally without modification, e.g. for use with standard yarn material or round cross-section.

What is claimed is:

1. A system for transferring a yarn from one part of a machine to a second part of the machine comprising a first clip at a yarn transfer position having a first pair of jaws, each of said jaws having a clamping surface facing a clamping surface on the other of said jaws, and at least one of said jaws being movable relative to the other of said jaws; and a second clip disposed coaxially of said first clip at said yarn transfer position and having a second pair of jaws, each of said jaws having a clamping surface facing a clamping surface on the other of said jaws, and at least one of said jaws being movable relative to the other of said jaws, said clamping surfaces of said second pair of jaws being disposed in cross-wise relation to said clamping surfaces of said first pair of jaws at an angle differing from 90° by at least 4°.

2. A system as set forth in claim 1 wherein said clamping surfaces of at least one of said clips are disposed at an inclined angle relative to the direction of movement of said movable jaw of said one clip.

3. A system as set forth in claim 2 wherein at least one of said jaws of each clip has a lateral guide element projecting towards the other of said jaws of each clip to guide said jaws relative to each other.

4. A system as set forth in claim 1 wherein said clamping surfaces of at least one clip are uneven and twisted with consecutive boundary lines of each said clamping surface being twisted.

5. A system as set forth in claim 4 wherein at least one of said jaws of each clip has a lateral guide element projecting towards the other of said jaws of each clip to guide said jaws relative to each other.

6. In combination with a weaving machine having a yarn regulator and at least one shuttle for picking a weft yarn of ribbon type through a shed, a transfer system for transferring the weft yarn from said yarn regulator to said shuttle, said transfer system comprising a first clip mounted in said yarn regulator and having a pair of jaws, each jaw having a clamping surface facing a clamping surface of the other jaw to clamp the weft yarn therebetween and a second clip mounted on said shuttle coaxially of said first clip and having a pair of jaws, each said jaw of said second clip having a clamping surface facing a clamping surface of the other jaw of said second clip to clamp the weft yarn therebetween, said clamping surfaces of said clips being disposed in substantially cross-wise relation to each other and at an angle of at least 4° from a perpendicular relationship.

7. A system for transferring a ribbon-type yarn from one part of a machine to a second part of the machine comprising a first clip at a yarn transfer position having a first pair of jaws, each of said jaws having a clamping surface facing a clamping surface on the other of said jaws, and at least one of said jaws being movable relative to the other of said jaws in a first plane; and a second clip at said yarn transfer position having a second pair of jaws, each of said jaws having a clamping surface facing a clamping surface on the other of said jaws, and at least one of said jaws being movable relative to the other of said jaws, said jaws of said second clip being disposed for relative movement in a second plane perpendicular to said first plane, said clamping surfaces of said second pair of jaws being disposed in cross-wise relation to said clamping surfaces of said first pair of jaws at an angle differing from 90° by at least 4°.

8. A system as set forth in claim 7 wherein said jaws of said first and second clips are coaxially disposed at said transfer station.

* * * * *

UNITED STATES PATENT AND TRADEMARK OFFICE

CERTIFICATE OF CORRECTION

PATENT NO. : 4,076,052

DATED : February 28, 1978

INVENTOR(S) : Hans Demuth

It is certified that error appears in the above-identified patent and that said Letters Patent are hereby corrected as shown below:

Column 1, line 42, change "polyethyelene" to --polyethylene--

Column 3, line 16, change "shittle" to --shuttle--

Column 3, line 48, after "3" delete --is--

Column 3, line 55, change "extend" to --expand--

Column 4, line 32, after "yarn" insert --end--

Column 4, line 36, change "FIGs" to --FIGS--

Column 5, line 24, change "typing" to -- tying --

Column 5, line 29, change "or" to --of--

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*